US005639996A

United States Patent [19]

Tan

[11] Patent Number: 5,639,996

[45] Date of Patent: Jun. 17, 1997

[54] ASYMMETRICALLY RESONANCE TUNED SPEAKER-BOX

[76] Inventor: Yu-Wah Tan, 60 Cheyenne Ct., Fremont, Calif. 94539

[21] Appl. No.: 558,903

[22] Filed: Nov. 16, 1995

[51] Int. Cl.[6] ..... A47B 81/06

[52] U.S. Cl. ..... 181/199

[58] Field of Search ..... 181/199, 146, 181/151, 148, 160; 381/159, 158

[56] References Cited

U.S. PATENT DOCUMENTS

| | | | |
|---|---|---|---|
| 2,991,840 | 7/1961 | Van Camp | 181/199 |
| 4,044,855 | 8/1977 | Kobayashi | 181/151 |
| 4,439,644 | 3/1984 | Bruney, III | 181/199 X |
| 5,519,178 | 5/1996 | Ritto et al. | 181/199 |

*Primary Examiner*—Khanh Dang
*Attorney, Agent, or Firm*—Benman Collins & Sawyer

[57] ABSTRACT

An asymmetrically resonance speaker enclosure is disclosed. Each side of the speaker box is reinforced asymmetrically, ensuring that each side has different resonance characteristics. Thus, the peak in the speaker box resonance is spread out, thereby reducing the effect of box resonance on the sound and making the box resonance more susceptible to being masked by tonal adjustments in the system. In addition, the material used to construct the box has fast energy dissipation and no heavy internal cross bracing is used. These features reduce the smearing effect of the speaker box on sound produced by the speakers. Thus, a system using an asymmetrically tuned speaker enclosure will sound less "boxy," will have less compression in the sound stage, will reveal more detail to the listener and sound livelier.

12 Claims, 3 Drawing Sheets

ASYMMETRICALLY RESONANCE TUNED SPEAKER-BOX

FIELD OF THE INVENTION

The present invention relates to speaker boxes for use in audio systems, and more particularly to a method and system for limiting the effects of speaker box resonance.

BACKGROUND OF THE INVENTION

Audio systems typically employ speakers mounted in boxes to produce sound. The boxes holding the speakers are subject to vibrations caused by sound issuing from the speakers. As is known by those skilled in the art, all material that is subjected to vibrations can resonate. Under certain conditions, therefore, the speaker box resonates. This resonance is particularly noticeable when all sides of the box have similar resonance characteristics, creating a "peak" in the speaker box's resonance. This resonance can alter the tonal balance of the speaker system, making the system sound "boxy" because of echoes in the box, and compressing the sound stage, thereby adversely affecting the stereo image.

Although resonance cannot be eliminated, it can be controlled and its effects reduced. Conventional measures taken to control speaker box resonance employ combinations of the following approaches:

1) increasing the total mass of the speaker box;

2) using "dead" material for the construction of the speaker box, such as MDF (medium density fiberboard), concrete resin, etc.

3) using heavy construction material and cross bracing.

As is known to those skilled in the art, the conventional approaches of increasing the mass and stiffness of the box reduces, but cannot eliminate speaker box resonance. These conventional approaches also tend to shift the speaker box resonance peak closer to the upper bass and lower midrange region of the frequency spectrum. However, the adverse effects of the speaker box's resonance peak remain evident. The result is a stereo system producing lifeless sound.

Accordingly, what is needed is a system and method for controlling the resonance of a speaker box to reduce the effects of box resonance on the sound characteristics of the stereo system, while preserving a lively, natural sound. The present invention addresses such a need.

SUMMARY OF THE INVENTION

A speaker box in accordance with the present invention is disclosed in which the transient response of the box is increased, the storage of energy by the box is decreased, and the box resonance is spread out over a wider range of frequencies. These characteristics produce a sound with reduced "boxiness" and less compression in the sound stage. The speaker box comprises a method and system for constructing a box using hardwood, without any internal cross bracing. In addition, each side of the speaker box is reinforced internally and asymmetrically.

According to the system and method disclosed herein, the asymmetric reinforcements of the present invention cause each side of the box to have different resonance characteristics. Any peak in the speaker box resonance is, therefore, spread out. This feature reduces the effect of any box resonance on the sound, thereby increasing overall system performance. Because the speaker box is constructed of hardwood, it also has a better rate of energy dissipation.

Thus, the smearing effect that box resonance has on the overall sound is reduced, revealing the detail in the sound. In addition, the wood has harmonics that are closer to that of musical instruments employing box resonance to produce sound, such as string instruments. This feature results in a more natural sound. Because the speaker box has no heavy internal cross bracing, it has low mass and stores little energy. This also reduces the smearing effect that box resonance has on the sound.

DESCRIPTION OF THE INVENTION

The present invention relates to an improvement in speaker box construction. The following description is presented to enable one of ordinary skill in the art to make and use the invention and is provided in the context of a patent application and its requirements. Various modifications to the preferred embodiment will be readily apparent to those skilled in the art, and the principles herein may be applied to other embodiments. Thus, the present invention is not intended to be limited to the embodiment shown but is to be accorded the widest scope consistent with the principles and features described herein.

As discussed previously, conventional approaches rely primarily on increasing the mass of the box, using "dead" material for construction of the enclosure, and employing heavy construction material and cross bracing to reduce box resonance. The sides of conventional speaker boxes are symmetric. Thus, the resonance of traditional speaker boxes is still "peaky."

The present invention provides for a method and system for an asymmetrically resonance tuned speaker enclosure. The present invention will be described in terms of two preferred embodiments, each having reinforcements arranged in a particular asymmetric configuration. However, one of ordinary skill in the art will readily recognize that this method and system employs general principles, and will operate effectively for other types of materials and reinforcements of other asymmetric configurations.

Figure 1:
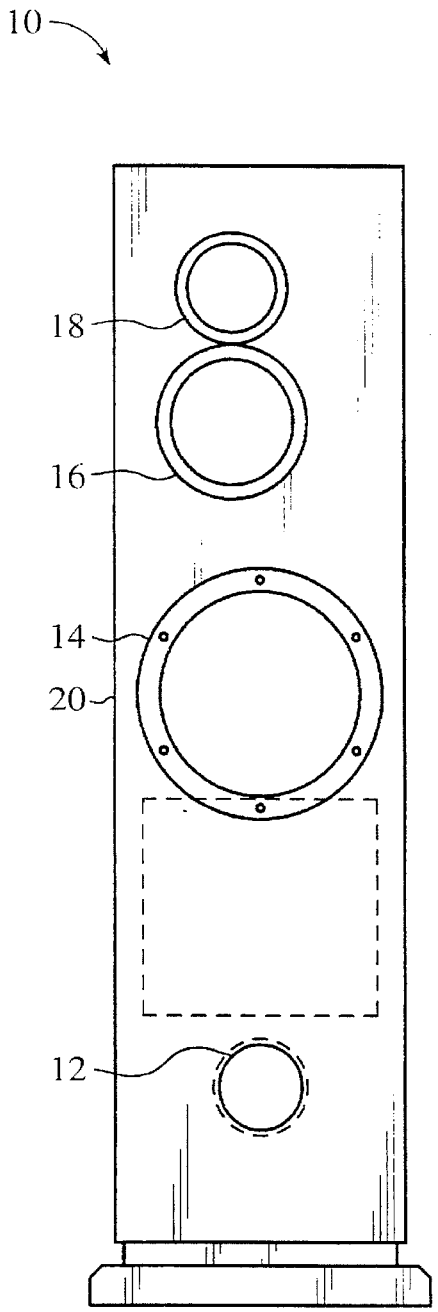
FIG. 1 is a schematic diagram of the front of a speaker designed according to the first embodiment.

To more particularly illustrate the speaker box in accordance with the present invention, refer now to FIG. 1, depicting the front view of the right speaker of one embodiment of such a system. FIG. 1 shows front 20 of speaker box 10, including speakers 12, 14, 16, and 18. Thus, the front outside of the speaker box in accordance with the present invention appears similar to conventional speakers. However, as discussed previously, the speaker box is comprised of hardwood, either solid hardwood or plywood. Because of the cellular structure of wood and the mineral content of hardwood, the box will have a better rate of energy dissipation than a box made of MDF or softwood.

Figure 2:
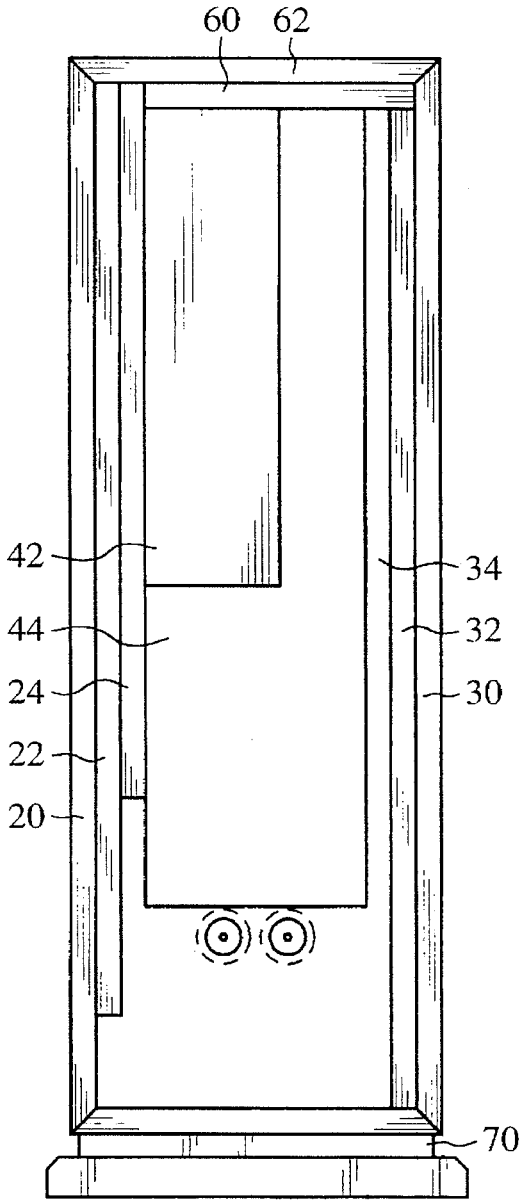
FIG. 2 is a schematic diagram of the side of a speaker designed according to the first embodiment.

FIG. 2, which depicts a side view of the interior of the first embodiment, displays additional differences between a speaker box in accordance with the present invention and one made using conventional approaches. Front 20, rear 30, and side 40 each have different internal reinforcements. Front 20 is reinforced by plywood panels 22 and 24. Back 30 is reinforced by panels 32 and 34. Note that back reinforcement panels 32 and 34 differ in size and placement from front reinforcement panels 22 and 24. Side 40 is reinforced by panels 42 and 44. Side reinforcement panels 42 and 44 differ from front reinforcement panels 22 and 24, and from back reinforcement panels 32 and 34. Finally, top 60 has reinforcement panel 62, which differs from unreinforced bottom 70.

Figure 3:
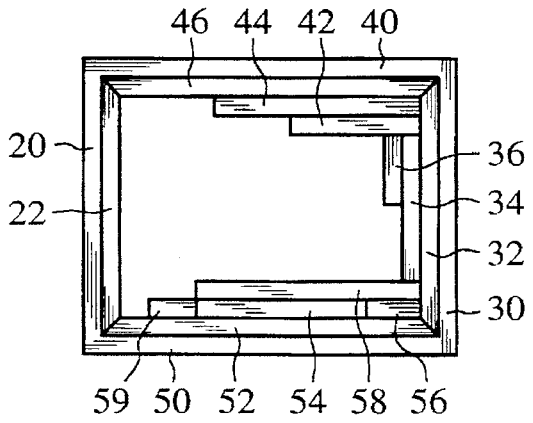
FIG. 3 is a schematic diagram of the top of a speaker designed according to the second embodiment.

FIG. 3, depicting the top view of the first embodiment, further illustrates asymmetric reinforcement in accordance with the present invention. In particular, front 20, back 30, and sides 40 and 50 all have reinforcement panels which differ in size and mass. In addition, the placement of the reinforcement panels differs for each side. Thus, the speaker box is reinforced asymmetrically. Because the reinforcement is asymmetric, each side of the speaker box has different resonance characteristics. Consequently, a potential peak in the speaker box resonance is spread out over a range of frequencies. The resonance of the speaker box is, therefore, more easily masked by adjusting the tonal balance of the speaker system.

Finally, note that no internal cross bracing is shown in FIGS. 1–3. This lack of cross bracing makes the speaker box lighter, thereby minimizing the smearing effect box resonance has on the overall sound. Thus, the speaker box shown in FIGS. 1–3 spreads any peak in the speaker box resonance and minimizes the smearing effect of box resonance. The sound system, therefore, can mask the effect of box resonance and reveal the detail of the sound produced by the speakers.

Figure 4:
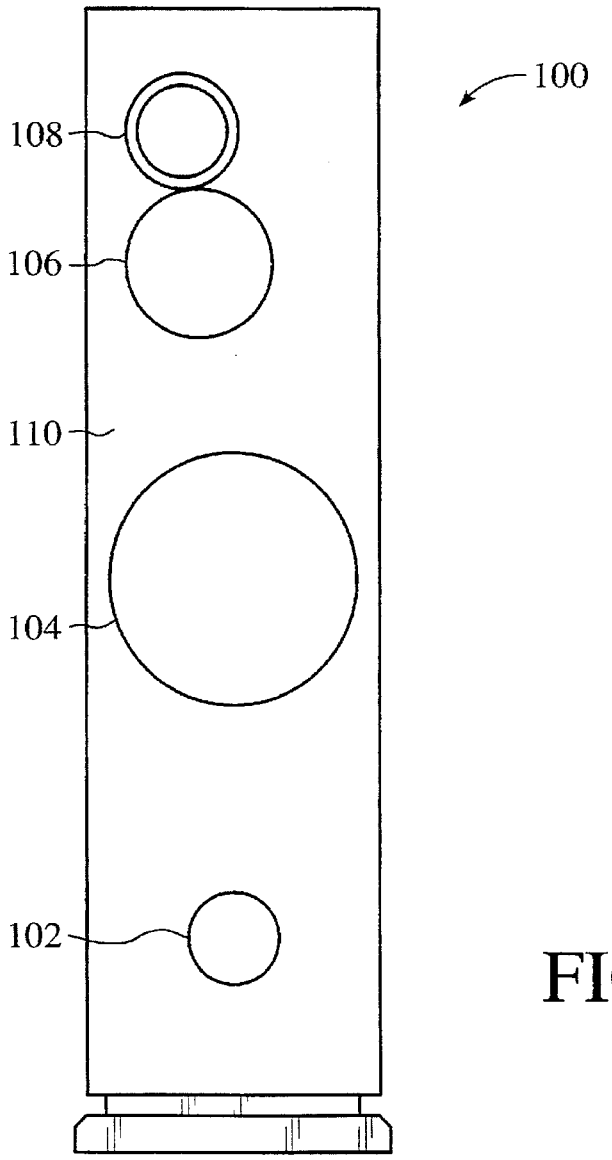
FIG. 4 is a schematic diagram of the front of a speaker designed according to the second embodiment.

FIG. 4 depicts front 110 of the second embodiment of speaker box 100. As with the box 10 of FIGS. 1–3, speaker box 100 is made of hardwood. Drivers 102, 104, 106, and 108 are shown. Unlike the first embodiment, drivers 106 and 108 are not vertically aligned.

Figure 5:
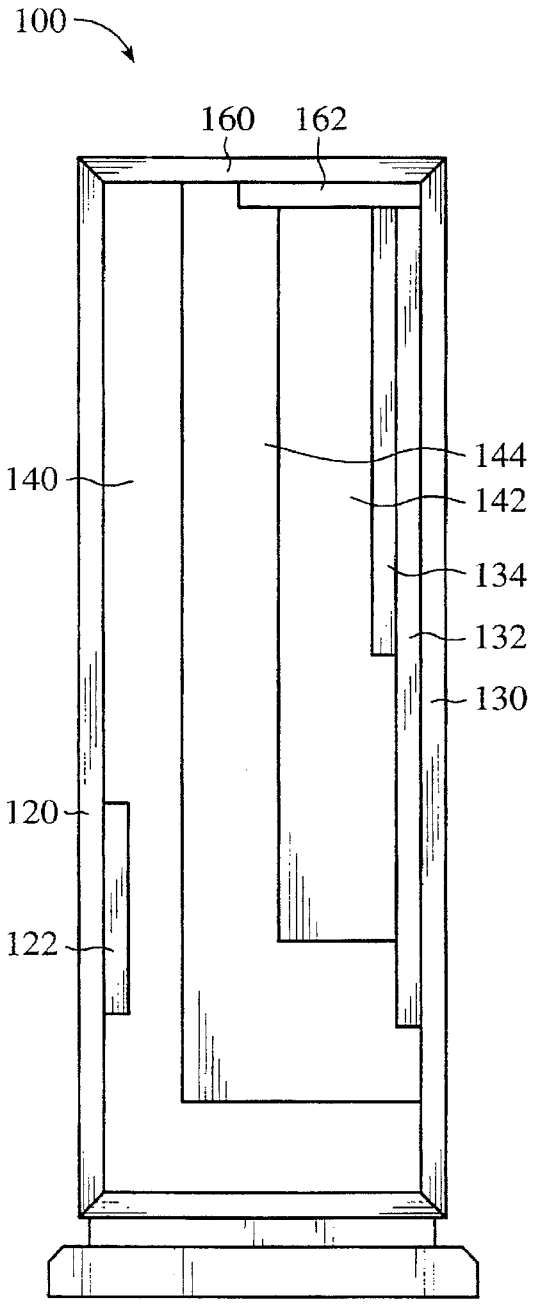
FIG. 5 is a schematic diagram of the side view of the second embodiment.
Figure 6:
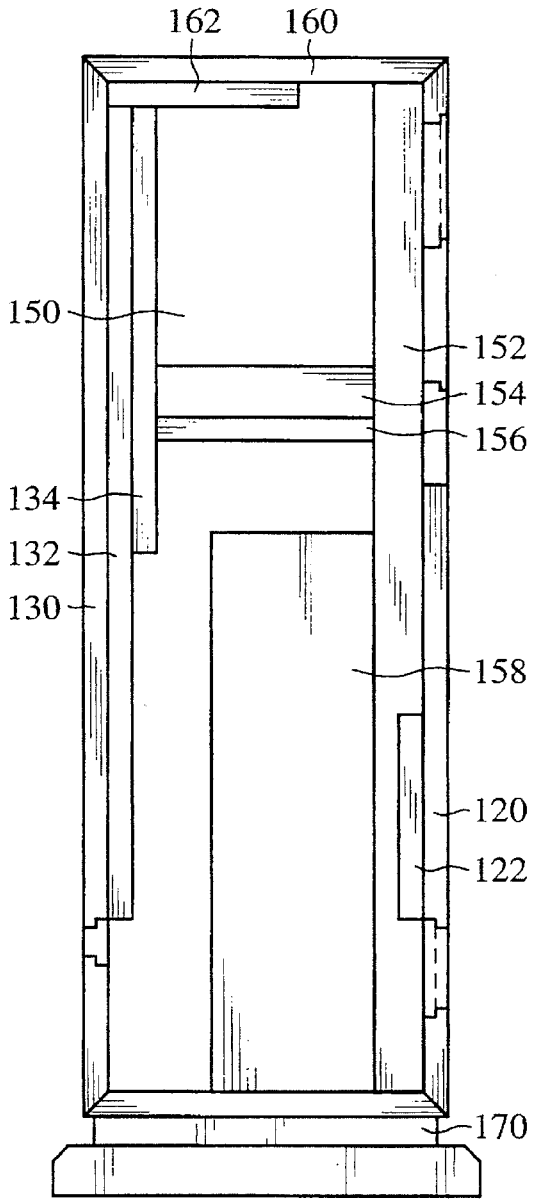
FIG. 6 is a schematic diagram of another side view of the second embodiment.

FIGS. 5 and 6 depict two opposing side views of the second embodiment. These figures demonstrate that front 120, back 130, sides 140 and 150, top 160 and bottom 170 all have reinforcement panels arranged in different configurations and having different masses. Thus, a peak in the box resonance is spread over a range of frequencies, thereby reducing the effect of box resonance on sound quality. In addition, note that no internal cross bracing is used in the second embodiment.

A method and system has been disclosed for an asymmetrically tuned speaker enclosure. The resonance characteristics of each side of the box are desynchronized using internal reinforcements arranged in an asymmetric configuration. In the preferred embodiments, the asymmetrically tuned speaker enclosure is comprised of hardwood and has no internal cross bracing for fast energy dissipation. Thus, a speaker system using the asymmetrically tuned speaker enclosure has reduced distortion due to any peak in the box resonance and finer details in the sound are revealed to the listener.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A speaker box comprising:

a front having a first edge, a second edge, a top and a bottom;

a first side having a front edge, a back edge, a top edge, and a bottom edge, the front edge of the first side being coupled to the first edge of the front;

a second side having a front edge, a top edge, a bottom edge, and a back edge, the front edge of the second side being coupled to the second edge of the front;

a back having a top edge and a bottom edge coupled to the back edge of the first side and the back edge of the second side;

a top coupled to the top edge of each of the front, the first side, the second side, and the back;

and a bottom coupled to the bottom edge of each of the front, the back the first side, and the second side;

the front, the back, the first side, the second side, the top, and the bottom being selectively and asymmetrically reinforced, thereby ensuring that the front, the back, the first side, the second side, the top, and the bottom each has different resonance characteristics.

2. The speaker box of claim 1 wherein the front, the back, the first side, the second side, the top, and the bottom are selectively reinforced using a plurality of panels.

3. The speaker box of claim 2 wherein each of the plurality of panels is comprised of plywood.

4. The speaker box of claim 2 wherein each of the plurality of panels has a different shape.

5. The speaker box of claim 2 wherein each of the plurality of panels has a different mass.

6. The speaker box of claim 1 wherein the front, the back, the first side, the second side, the top, and the bottom are comprised of hardwood.

7. A method of building a speaker box comprising the steps of:

providing a front having a first edge, a second edge, a top and a bottom, a first side having a front edge, a back edge, a top edge, and a bottom edge, the front edge of the first side being coupled to the first edge of the front, a second side having a front edge, a top edge, a bottom edge, and a back edge, the front edge of the second side being coupled to the second edge of the front, a back having a top edge and a bottom edge coupled to the back edge of the first side and the back edge of the second side, a top coupled to the top edge of each of the front, the first side, the second side, and the back, and a bottom coupled to the bottom edge of each of the front, the back, the first side, and the second side; and selectively and asymmetrically reinforcing each of the front, the back, the first side, the second side, the top, and the bottom to ensure that the each of the front, the back, the first side, the second side, the top, and the bottom each has different resonance characteristics.

8. The method of claim 7 wherein the step of selectively reinforcing the front, the back, the first side, the second side, the top, and the bottom is carried out using a plurality of panels.

9. The method of claim 8 wherein the plurality of panels are comprised of plywood.

10. The method of claim 8 wherein each of the plurality of panels has a different shape.

11. The method of claim 8 wherein each of the plurality of panels has a different mass.

12. The method of claim 7 wherein the front, the back, the first side, the second side, the top, and the bottom are comprised of hardwood.

* * * * *